United States Patent [19]

Bush

[11] 4,249,886

[45] Feb. 10, 1981

[54] COMBUSTION CONTROL SYSTEM

[75] Inventor: Forest L. Bush, Mission Viejo, Calif.

[73] Assignee: Westinghouse Electric Corp., Pittsburgh, Pa.

[21] Appl. No.: 41,448

[22] Filed: May 22, 1979

[51] Int. Cl.[3] ..... F23K 5/00; F23N 1/02

[52] U.S. Cl. ..... 431/90; 431/12; 137/6; 236/15 E

[58] Field of Search ..... 431/12, 89, 90; 137/6; 236/15 E, 15 C

[56] References Cited

U.S. PATENT DOCUMENTS 3,549,089 12/1970 Hamlett ..... 431/12 X 3,814,570 6/1974 Pillard et al. ..... 236/15 E X 4,157,238 6/1979 Van Berkum ..... 431/12

*Primary Examiner*—Robert S. Ward, Jr.

*Attorney, Agent, or Firm*—C. M. Lorin

[57] ABSTRACT

The well-known "Jack-shaft" or "Single-point" positioning or a two-point parallel combustion control system has been modified by a trim link member articulated on the master arm to introduce a phase angle between the master arm associated with fuel supply adjustment and the slave arm associated with the combustive agent supply adjustment in a combustion engine, boiler, heater, or the like, thereby to permit oxygen or air-to-fuel ratio adjustment at all times.

4 Claims, 6 Drawing Figures

FIG.I.

COMBUSTION CONTROL SYSTEM

BACKGROUND OF THE INVENTION

The invention relates to combustion control of a combustion engine, boiler, heater, or the like.

The object of the present invention is to provide an improved combustive-to-combustible ratio for fuel combustion.

It is known to mechanically connect the organs controlling fuel feed and air, or oxygen intake, so as to establish a definite and selectable air-to-fuel, or oxygen-to-fuel, ratio. The simplest and least expensive combustion control system is known as the "Jack-shaft" or "Single-point" positioning system. It consists in mechanical arms, one master arm connected to the main shaft for controlling the fuel valves and a slave arm connected to the air damper, with an interconnecting link. This arrangement establishes a master-slave relationship between fuel and air adjustment. The interconnecting link in the prior art is adjusted as a result of calibration. The air-to-fuel ratio, however, requires frequent adjustments before and during operation in order to maximize combustion efficiency. Although this can be done by changing the interconnecting points at the opposite ends of the link, or by reducing the interconnecting link itself, this approach is time consuming and it necessitates a recalibration, each time.

SUMMARY OF THE INVENTION

The present invention uses the basic simple and low cost arrangement of the prior art but proposes to modify it with a trim link that can be readily and angularly modified while the engine, boiler, or heater, is in operation, and without having to recalibrate the system. At a time of fuel shortage and high fuel prices, the invention represents a most desirable cost saving improvement.

DESCRIPTION OF THE PREFERRED EMBODIMENT

Figure 1:
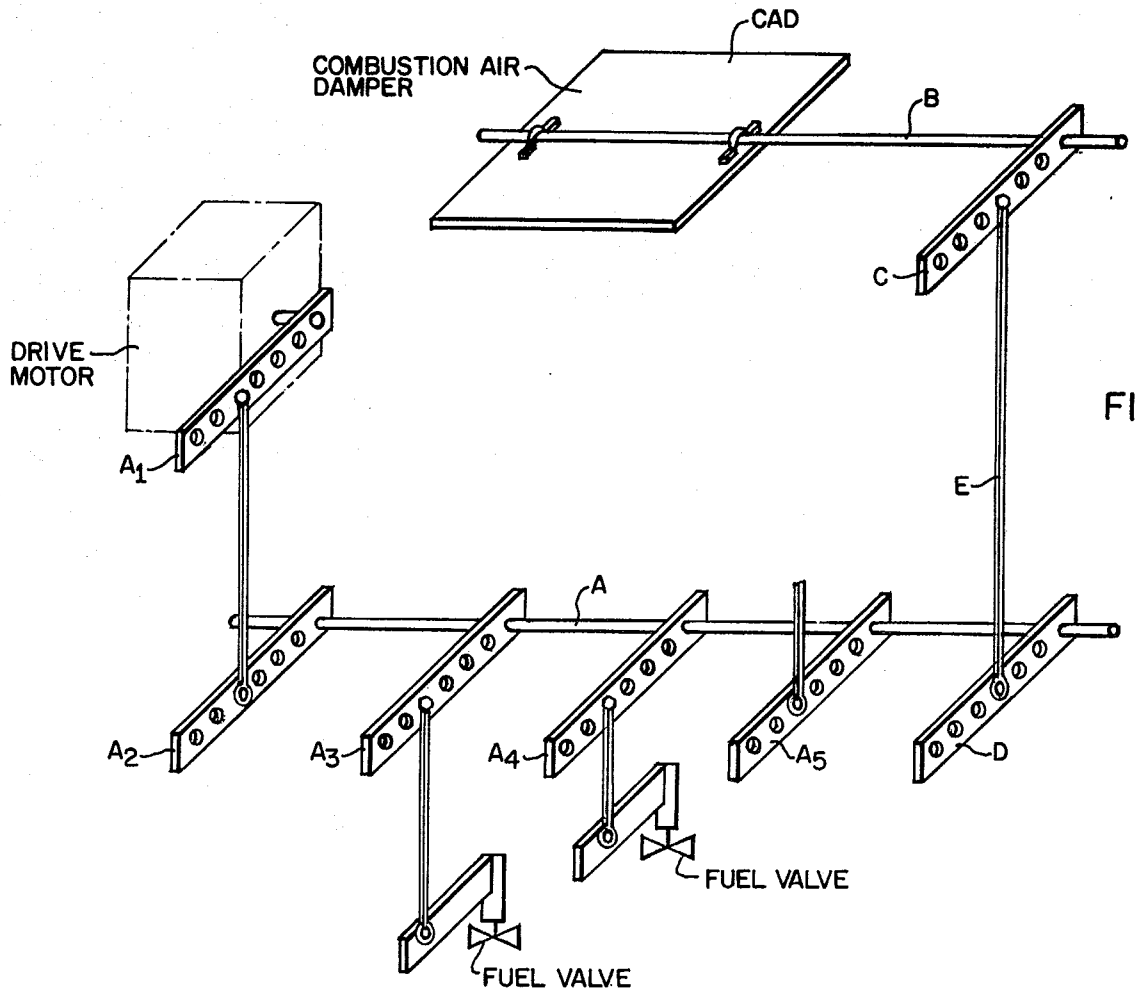
FIG. 1 shows a combustion control system of the prior art.

Referring to FIG. 1, a combustion control system of the prior art known as the "Jack-shaft", or "Single-point", positioning system is shown. This arrangement is the most used because of its low cost and reliability, especially for gas and oil filled boilers. The drive motor of the system is shown having two arms $A_1$, $A_2$ interlinked by a linking member LK, for actuating a main shaft A. Shaft A actuates through arms $A_3$, $A_4$, respective fuel valves and through an arm $A_5$ it actuates a register (not shown). Shaft A also rotates an arm D which is interconnected via a connecting link E with an arm C mounted on a second shaft B. Shaft B is thus a slave of the master shaft A. When shaft B is rotated, a combustion air damper CAD is orientated in different planes to increase or decrease the air intake. Arms $A_1$ to $A_5$, D and C are all provided with pigeon holes in order to permit length adjustment between shafts and connected members, thereby to vary the effect of the respective arms in the system.

Once calibrated, or set up, this system provides no means of varying the % of rotation between shaft "A" (fuel train) and shaft "B" (combustion air damper position) without having to physically loosen arm D or C and reclamp it at a new position on its shaft, or changing the length of connection link E.

On this type of combustion conrtrol system, the arms on shaft A position the fuel valves (oil, gas and atm. stm.), thus the relative position represents a specific volume of fuel flow to the burner. Likewise, the position of shaft B represents a specific volume of combustion air flow to the burner. If, after an initial relationship or characterization between fuel valves and combustion air damper has been established, there occurs a change in the BTU value of the fuel, viscosity of the fuel, combustion air temperature, valve wear, burner clogging, etc., the original calibrated relationship between fuel and air burner clogging, etc., the original calibrated relationship between fuel and air no longer exists. Such a discrepancy can occur several times a day.

The total fuel cost for operation of a boiler, or heater, can be significantly reduced by maintaining the proper fuel/air ratio throughout the full firing range and by readily correcting the fuel/air ratio once it has been upset by outside influence (air density change, fuel BTU change, etc.).

In a time of fuel shortage and high fuel prices, it becomes economically desirable to increase combustion efficiency by maintaining at all times the proper fuel-to-air ratio.

Although money can be saved by maintaining the proper fuel/air ratio, very few plants have installed systems that provide a means of controlling the fuel/air ratio. The reason is cost and down time. Either a complete new type of combustion control system has to be designed, or extensive modifications of the existing single point positioning system have to be made. In either case, boiler down time, recalibration of the new system, and expensive installation time are required.

Figure 2:
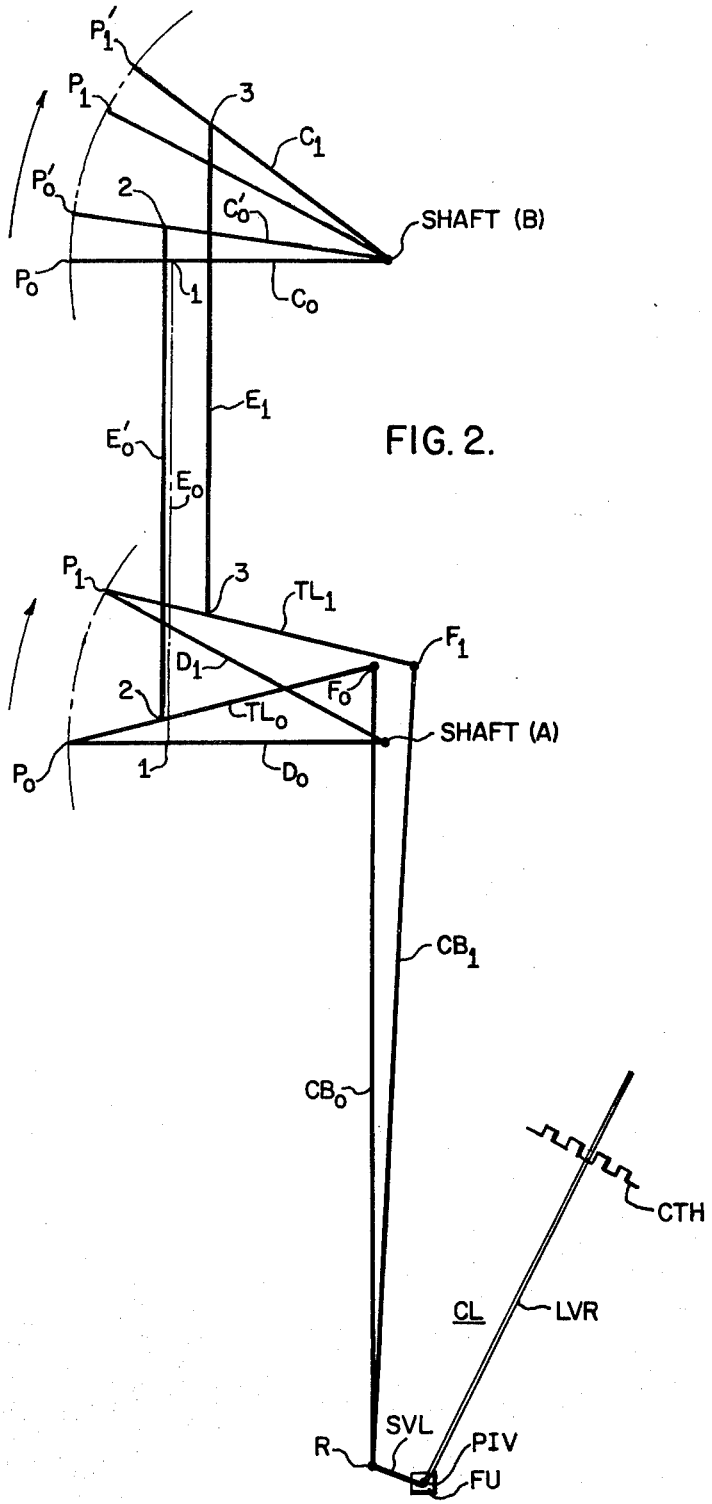
FIG. 2 shows the combustion control system of FIG. 1 as modified in accordance with the present invention.

Referring to FIG. 2, arm D of FIG. 1 is shown in two successive positions $D_0$, $D_1$, and arm C in two successive positions $C_0$, $C_1$ assuming it is connected, as shown in dotted line, by an intermediate linke $E_0$ ($E_1$), like in FIG. 1. According to the present invention, the intermediate link E no longer exists between the master arm D of shaft A and the slave arm C of shaft B. Instead, the master-slave relationship between arm D and arm C is obtained through a trim link TL itself connected to arm C by an intermediate link E'. The trim link TL is an arm pivotally mounted at the extremity P of arm D so that TL can be shifted by a selected angle $\alpha$ away from alignment with arm D. When aligned with arm D trim link TL actuates arm C through the intermediate link E' just like in the situation of FIG. 1. When trim link TL receives an angular displacement $\alpha$ away from alignment, the intermediate link E' causes the slave arm C to assume a position C' which is different from the position C of FIG. 1 by a phase angle related to the angle of TL against arm D. FIG. 2 shows the trim link TL and the intermediate link E' for two successive positions $TL_0$, $TL_1$ and $E'_0$, $E'_1$ corresponding to the positions $D_0$, $D_1$ of arm D. As a result, the slave arm C assumes positions $C'_0$ and $C'_1$, rather than the positions $C_0$, $C_1$ it would assume in the situation of FIG. 1.

Adjustment of $\alpha$ is controlled by a control bar CB (shown for two positions $CB_0$, $CB_1$) which is pivotally connected with the free end F of the trim link TL ($F_0$, $F_1$ for positions $TL_0$, $TL_1$). Control bar CB is actuated by a control lever CL mounted on a fulcrum FU and having a pivotal point PIV, a long arm LVR and a short arm SVR. Control bar CB is articulated at R with the free end of the short arm SVL. The long arm LVR is fixed in a selected position by a catch CTH. The operator selects the angle $\alpha$ by giving lever CL a desired orientation about pivot PIV. It is understood that when shaft A brings the master arm D from position $D_0$ into position $D_1$, the control bar, because it is constrained by its end R which is fixed by the control lever CL, will assume two positions $CB_0$ and $CB_1$ in space about point R, and trim link TL will go from position $TL_0$ to position $TL_1$ while keeping the same angle $\alpha$ against arm D.

With such arrangement it appears that for a position $D_0$ corresponding to zero fuel admission when calibrated, the slave arm $C'_0$ is displaced from the position $C_0$ corresponding to the situation of FIG. 1. Therefore, the trim link TL has introduced an advance for the air intake by the slave arm C. It also appears that for position $D_1$ the slave arm is at C', rather than $C_1$. It should be noted, however, that for the sake of clarity the arm positions have been given on the drawing an exagerated divergence. In fact, while the initial advance has a controlled and marked effect on firing of the combustion apparatus, this effect is attenuated later when the master and slave arms reach their normal operative positions. It is clear that control bar CB and conrol lever CL can be used to shift trim link TL away from alignment forward or toward the rear of arm D. Thus, the air intake may be "retarded", as well as "advanced". Moreover, during operation, angle $\alpha$ may be adjusted at any time. This means that, while deriving an indication of the efficiency of the combustion, for instance in a boiler operating with oxygen injection, it is possible to select at all times the best oxygen, or air-to-fuel ratio.

The trim link arrangement of FIG. 2 eliminates all the above stated problems and costs of the arrangement of FIG. 1. The trim link arrangement may be returned to the single-point positioning system of FIG. 1 while the boiler is in operation, thus eliminating the down time. Because it does not fundamentally change the organization of the existing system it requires no recalibration thus eliminating the cost and time involved for recalibration.

The invention is directly applicable to many types of combustion control systems. For instance, it may be applied to any basic jackshaft system, e.g., to the single-point positioning system of FIG. 3, or to a 2 point-parallel positioning combustion control system with oxygen trim control and load set point programming like in FIG. 4.

Figure 3:
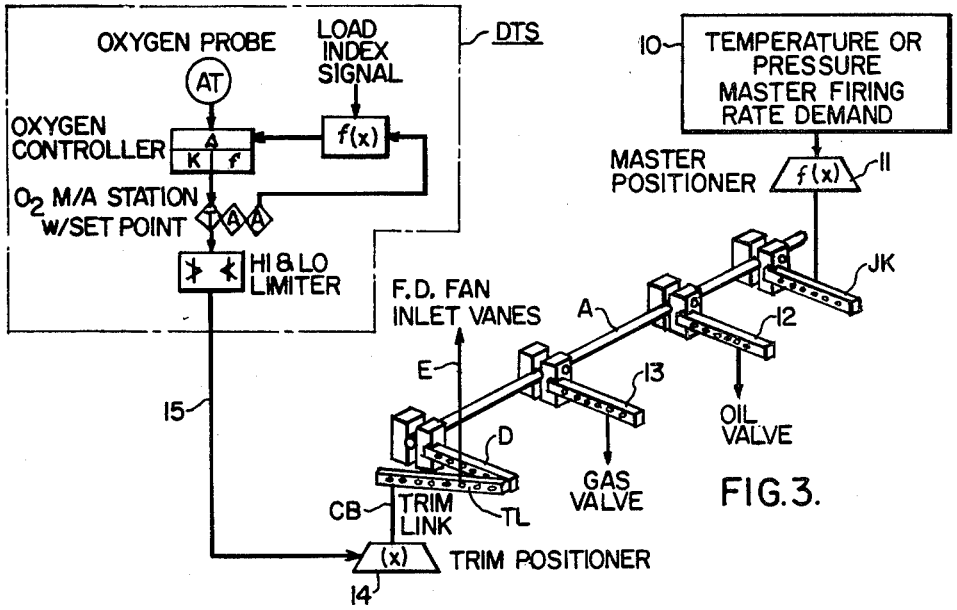
FIG. 3 is a single point jackshaft combustion control system with oxygen trim control and load setpoint programming, in accordance with the present invention.

Referring to FIG. 3, the jackshaft A via arm JK is positioned by a master controller 10 which measures the process variable being controlled, normally either pressure or temperature, and compares it to the desired value. Should an error exist the master controller will take proportional plus integral action on the error causing the master controller output to move in the proper direction to eliminate the error.

The output change of the master is sent to the master positioner 11 which moves the jackshaft A and arm JK. The fuel valves and F.D. Fan Inlet Vanes are connected to this jackshaft through shaft A and the linkage and levers such as 12, 13. It is through the effective lengths of the fuel and air levers, and their orientation relative to each other on the jackshaft, that the system establishes the fuel/air ratio over the entire operating range.

With a fixed fuel/air ratio, along with the difficulty of changing this ratio, there is a need for an inexpensive method of changing the fuel/air ratio to take advantage of the fuel savings trim systems used on larger boilers. Therefore, through trim link TL associated with lever D an Oxygen Trim Control System connects the trim positioner to the jackshaft end of the floating arm. This is done via a connecting rod CB to the trim positioner 14 from the trim link TK. Stroking of the trim positioner provides the positive limits on the amount of trim allowed.

The $O_2$ controller output on line 15 will adjust the position of the arm TK thus increasing or decreasing the air flow through E which will change the air to fuel relationship.

The load index signals which may be available to represent boiler load will probably be somewhat limited on a jackshaft control sytem. The master control signal or steam flow are acceptable signals available and compatible with the oxygen trim control.

The addition of the Oxygen Trim Control will compensate for the changes in fuel as well as boiler and atmospheric conditions.

Figure 4:
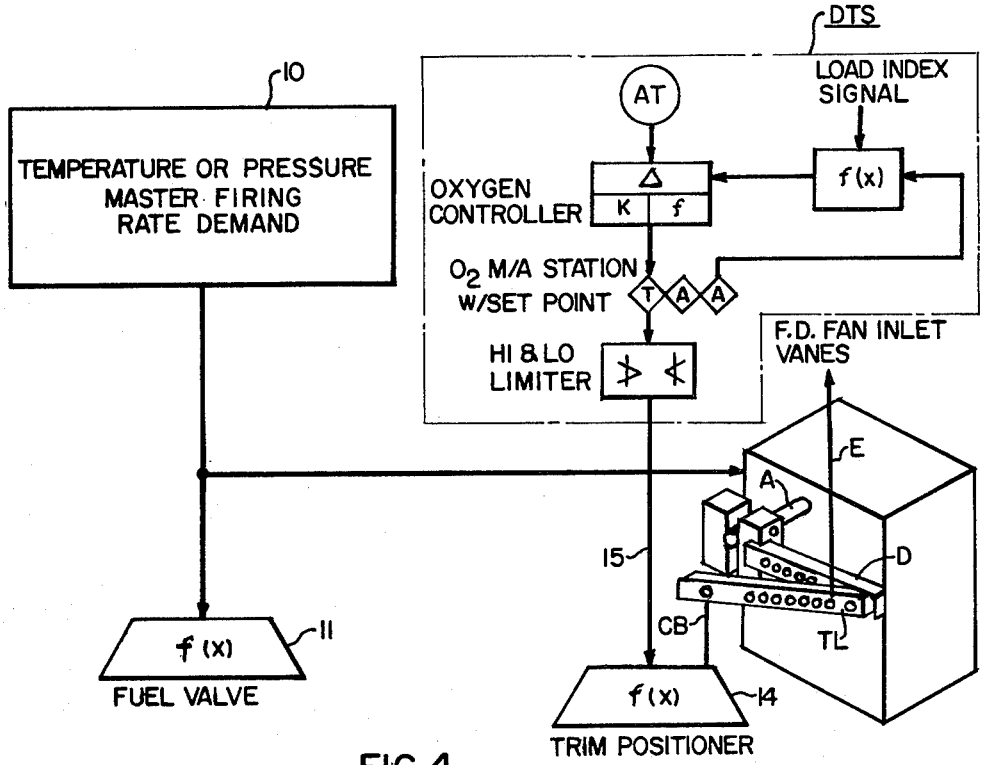
FIG. 4 is a two-point parallel combustion control system with oxygen trim control and load setpoint programming in accordance with the present invention.

Referring to FIG. 4, an oxygen trim system like schematically shown in FIG. 4, is added to a parallel positioning system. Here, the master controller 10 actuates arm A while the fuel valves are directly controlled by the master positioner 11 rather than by arm A. The oxygen trim system OTS is regulating, by line 15, the trim positioner 14. Trim link TL on arm D and shaft A controls the adjustment of the F-D fan inlet vanes while being adjusted by trim positioner 14 via link CB.

The trim link TL is installed on the output shaft of the existing F.D. Fan Inlet Vane Actuator. The intermediate link E to the F.D. Fan Inlet Vane is connected to the floating arm, or trim link TL. The Oxygen Trim Control Actuator is connected to the free end of the floating arm. The existing F.D. Fan Inlet Vane Actuator will position the trim link TL in response to the Master Controller demand. The Oxygen Trim Control Actuator will adjust the F.D. Fan Inlet Vane positioning by adjusting the angular position of the trim link TL in response to the Oxygen content in the flue gases.

The addition of the Oxygen Trim Control will compensate for the changes in fuel as well as boiler and atmospheric conditions.

Figure 5B:
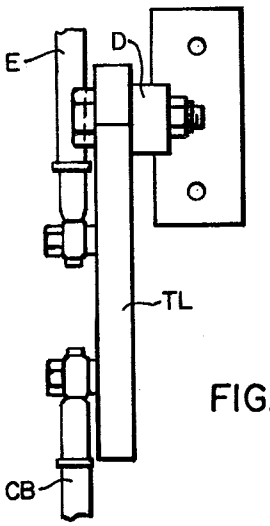
FIGS. 5A and 5B show a mechanical mounting of the trim link according to the invention with arm D for any of the previous embodiments of the invention.
Figure 5A:
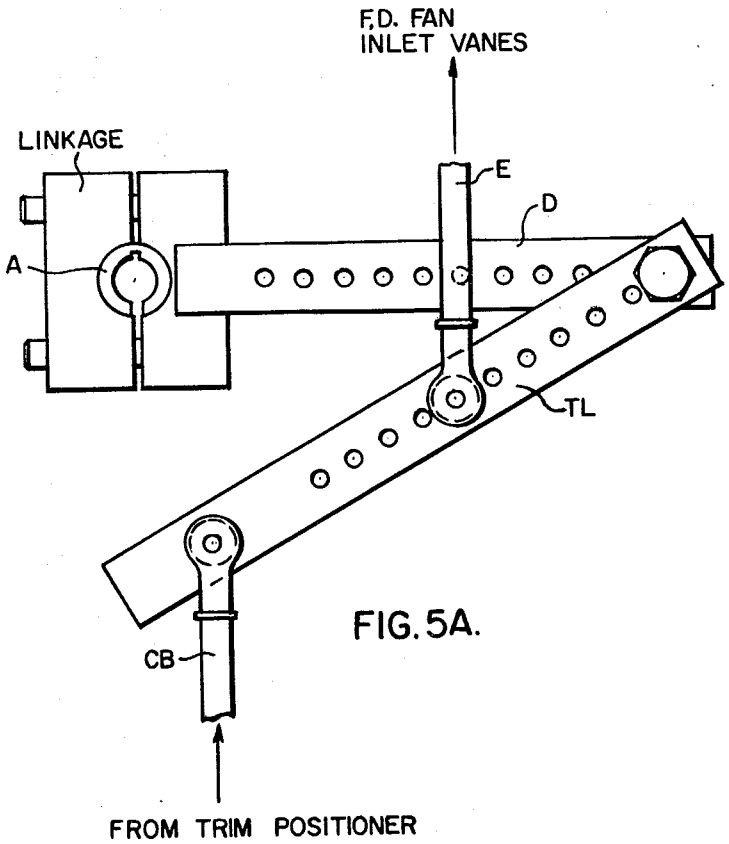

Referring to FIGS. 5A and 5B, an actual realization of the articulation of trim link TL with arm D is shown as a projected view in FIG. 5A, as a lateral view in FIG. 5B. Rods E, to the F.D. Fan Inlet Vane, and CB from the trim positioner are illustrated.

I claim:

1. In a combustion apparatus supplied with fuel mixed with an intake of a combustive agent, the combination of:

a master member having an extremity movably mounted about a first axis for regulating the amount of fuel supplied;

a slave member having an extremity movably mounted about a second axis for regulating the amount of combustive agent intake;

a trim member positioned at a selectable angle relative to said master member and about the extremity thereof; and an intermediate mechanical link connected between said trim member and said slave member for establishing said master-slave relationship through said trim member thereby to establish a fuel-to-combustible agent ratio which is a function of said selectable relative angle.

2. The apparatus of claim 1 with said intermediate link being adjustably connected to said trim member and to said slave member.

3. The apparatus of claim 1 with means for independently adjusting said adjustable relative member.

4. The apparatus of claim 3 with said adjusting means being operative on an extremity of said trim member opposite to said master member extremity.

* * * * *